US009631782B2

(12) United States Patent
Harbers et al.

(10) Patent No.: US 9,631,782 B2
(45) Date of Patent: Apr. 25, 2017

(54) LED-BASED RECTANGULAR ILLUMINATION DEVICE

(75) Inventors: Gerard Harbers, Sunnyvale, CA (US); Kelly C. McGroddy, San Francisco, CA (US); Christopher R. Reed, Campbell, CA (US)

(73) Assignee: Xicato, Inc., San Jose, CA (US)

( * ) Notice: Subject to any disclaimer, the term of this patent is extended or adjusted under 35 U.S.C. 154(b) by 666 days.

(21) Appl. No.: 13/015,431

(22) Filed: Jan. 27, 2011

(65) Prior Publication Data

US 2011/0182068 A1 Jul. 28, 2011

Related U.S. Application Data

(60) Provisional application No. 61/301,546, filed on Feb. 4, 2010.

(51) Int. Cl.
*F21K 9/64* (2016.01)
*F21K 9/233* (2016.01)
(Continued)

(52) U.S. Cl.
CPC ..... *F21K 9/64* (2016.08); *F21K 9/233* (2016.08); *F21K 9/62* (2016.08); *F21Y 2101/00* (2013.01);
(Continued)

(58) Field of Classification Search
CPC ... F21K 9/64; F21K 9/62; F21K 9/233; F21Y 2105/10; F21Y 2101/00; F21Y 2115/10
(Continued)

(56) References Cited

U.S. PATENT DOCUMENTS 3,851,164 A * 11/1974 Intrator ..... 362/7
4,277,820 A * 7/1981 Bostonian ..... 362/223
(Continued)

FOREIGN PATENT DOCUMENTS

EP 1548851 A2 6/2005
EP 1780592 A1 5/2007
(Continued)

OTHER PUBLICATIONS

International Search Report and Written Opinion mailed on Jul. 14, 2011 for International Application No. PCT/US2011/022986, 12 pages.
(Continued)

*Primary Examiner* — Sharon Payne
(74) *Attorney, Agent, or Firm* — Silicon Valley Patent Group LLP

(57) ABSTRACT

An illumination device includes a plurality of Light Emitting Diodes (LEDs) in a rectangular light mixing cavity mounted above the LEDs and configured to mix and color convert light emitted from the LEDs. The long sidewall surfaces of the rectangular light mixing cavity are coated with a first type of wavelength converting material while the short sidewall surfaces reflect incident light without color conversion. The output window that is above and separated from the LEDs is coated with a second type of wavelength converting material. The light mixing cavity may include a replaceable, reflective insert that includes a non-metallic, diffuse reflective layer backed by a second reflective layer. Additionally, the LEDs may be mounted on raised pads on a mounting board. The light mixing cavity may include a bottom reflector with holes wherein the raised pads elevate the LEDs above the top surface of the bottom reflector through the holes.

14 Claims, 10 Drawing Sheets

(51) Int. Cl.

| | |
|---|---|
| ***F21K 9/62*** | (2016.01) |
| *F21Y 101/00* | (2016.01) |
| *F21Y 105/10* | (2016.01) |
| *F21Y 115/10* | (2016.01) |

(52) U.S. Cl.
CPC ..... *F21Y 2105/10* (2016.08); *F21Y 2115/10* (2016.08)

(58) Field of Classification Search
USPC ..... 362/235, 84, 231, 293
See application file for complete search history.

(56) References Cited

U.S. PATENT DOCUMENTS

| | | | | |
|---|---|---|---|---|
| 5,962,971 | A | 10/1999 | Chen | |
| 5,966,393 | A | 10/1999 | Hide et al. | |
| 5,998,925 | A | 12/1999 | Shimizu et al. | |
| 6,066,861 | A | 5/2000 | Hohn et al. | |
| 6,068,383 | A | 5/2000 | Robertson et al. | |
| 6,220,725 | B1 | 4/2001 | Arnold | |
| 6,234,648 | B1 | 5/2001 | Borner et al. | |
| 6,340,824 | B1 | 1/2002 | Komoto et al. | |
| 6,351,069 | B1 | 2/2002 | Lowery et al. | |
| 6,357,889 | B1 | 3/2002 | Duggal et al. | |
| 6,469,322 | B1 | 10/2002 | Srivastava et al. | |
| 6,504,301 | B1 | 1/2003 | Lowery | |
| 6,547,416 | B2 * | 4/2003 | Pashley et al. | 362/231 |
| 6,576,930 | B2 | 6/2003 | Reeh et al. | |
| 6,577,073 | B2 | 6/2003 | Shimizu et al. | |
| 6,586,882 | B1 | 7/2003 | Harbers | |
| 6,600,175 | B1 | 7/2003 | Baretz et al. | |
| 6,621,211 | B1 | 9/2003 | Srivastava et al. | |
| 6,649,946 | B2 | 11/2003 | Bogner et al. | |
| 6,674,223 | B2 | 1/2004 | Kim | |
| 6,674,233 | B2 | 1/2004 | Ellens et al. | |
| 6,680,569 | B2 | 1/2004 | Mueller-Mach et al. | |
| 6,724,142 | B2 | 4/2004 | Ellens et al. | |
| 6,765,237 | B1 | 7/2004 | Doxsee et al. | |
| 6,791,259 | B1 | 9/2004 | Stokes et al. | |
| 6,812,500 | B2 | 11/2004 | Reeh et al. | |
| 6,850,002 | B2 | 2/2005 | Rossner et al. | |
| 7,004,679 | B2 | 2/2006 | Naka et al. | |
| 7,083,302 | B2 | 8/2006 | Chen et al. | |
| 7,126,162 | B2 | 10/2006 | Reeh et al. | |
| 7,250,715 | B2 | 7/2007 | Mueller et al. | |
| 7,344,952 | B2 | 3/2008 | Chandra | |
| 7,350,933 | B2 * | 4/2008 | Ng et al. | 362/84 |
| 7,431,479 | B2 | 10/2008 | Weaver, Jr. et al. | |
| 7,479,662 | B2 | 1/2009 | Soules et al. | |
| 7,494,246 | B2 | 2/2009 | Harbers et al. | |
| 7,503,676 | B2 * | 3/2009 | Sakumoto | 362/293 |
| 7,534,002 | B2 | 5/2009 | Yamaguchi et al. | |
| 7,555,194 | B2 * | 6/2009 | Ikeda et al. | 385/146 |
| 7,564,180 | B2 | 7/2009 | Brandes | |
| 7,614,759 | B2 | 11/2009 | Negley | |
| 7,629,621 | B2 | 12/2009 | Reeh et al. | |
| 7,646,030 | B2 * | 1/2010 | Chen et al. | 257/88 |
| 7,717,591 | B2 | 5/2010 | Weaver, Jr. et al. | |
| 7,726,856 | B2 * | 6/2010 | Tsutsumi | 362/510 |
| 7,845,825 | B2 * | 12/2010 | Ramer et al. | 362/231 |
| 8,097,894 | B2 * | 1/2012 | Bierhuizen et al. | 257/98 |
| 2002/0043926 | A1 | 4/2002 | Takahashi et al. | |
| 2005/0057145 | A1 | 3/2005 | Shieh et al. | |
| 2006/0087487 | A1 | 4/2006 | Ota | |
| 2006/0097245 | A1 | 5/2006 | Aanegola et al. | |
| 2006/0152140 | A1 | 7/2006 | Brandes | |
| 2007/0081336 | A1 | 4/2007 | Bierhuizen et al. | |
| 2007/0223219 | A1 | 9/2007 | Medendorp et al. | |
| 2007/0236933 | A1 | 10/2007 | Bierhuizen et al. | |
| 2007/0262334 | A1 | 11/2007 | Chiang et al. | |
| 2008/0128735 | A1 | 6/2008 | Yoo et al. | |
| 2008/0142816 | A1 | 6/2008 | Bierhuizen et al. | |
| 2009/0103296 | A1 | 4/2009 | Harbers et al. | |
| 2009/0116251 | A1 | 5/2009 | Harbers et al. | |
| 2010/0309648 | A1 | 12/2010 | Willemsen et al. | |
| 2011/0032449 | A1 | 2/2011 | Freier et al. | |

FOREIGN PATENT DOCUMENTS

| | | | | | |
|---|---|---|---|---|---|
| JP | 2008/45942 | A | * | 6/2008 | G02B 5/08 |
| KR | 729910 | B1 | * | 6/2007 | E01F 9/04 |
| TW | M300351 | U | | 11/2006 | |
| TW | 200926453 | A | | 6/2009 | |
| TW | 200947694 | A | | 11/2009 | |
| TW | 200949157 | A | | 12/2009 | |
| WO | 2007002234 | A1 | | 1/2007 | |
| WO | 2007102098 | A1 | | 9/2007 | |
| WO | 2007130536 | A2 | | 11/2007 | |
| WO | 2008142638 | A1 | | 11/2008 | |
| WO | 2008149250 | A1 | | 12/2008 | |
| WO | 2008157080 | A2 | | 12/2008 | |
| WO | 2009013695 | A2 | | 1/2009 | |
| WO | 2009021859 | A1 | | 2/2009 | |
| WO | WO 2009/016585 | A2 | | 2/2009 | |
| WO | WO 2009/016585 | A3 | | 2/2009 | |
| WO | 2009052099 | A1 | | 4/2009 | |
| WO | WO 2010/017523 | A1 | | 2/2010 | |

OTHER PUBLICATIONS

English Abstract of TW M300351 visited at www.espacenet.com on Jun. 7, 2013, 1 page.
English Abstract of TW 200926453 visited at www.espacenet.com on Jun. 7, 2013, 2 pages.
English Abstract of TW 200947694 visited at www.espacenet.com on Jun. 7, 2013, 2 pages.
English Abstract of TW 200949157 visited at www.espacenet.com on Jun. 7, 2013, 2 pages.
International Search Report and Written Opinion mailed on Jul. 14, 2011 for International Application No. PCT/US2011/022986 , 12 pages.

* cited by examiner

LED-BASED RECTANGULAR ILLUMINATION DEVICE

CROSS REFERENCE TO RELATED APPLICATIONS

This application claims the benefit of Provisional Application No. 61/301,546, filed Feb. 4, 2010, which is incorporated by reference herein in its entirety.

TECHNICAL FIELD

The described embodiments relate to illumination devices that include Light Emitting Diodes (LEDs).

BACKGROUND INFORMATION

The use of light emitting diodes in general lighting is still limited due to limitations in light output level or flux generated by the illumination devices due to the limited maximum temperature of the LED chip, and the life time requirements, which are strongly related to the temperature of the LED chip. The temperature of the LED chip is determined by the cooling capacity in the system, and the power efficiency of device (optical power produced by the LEDs and LED system, versus the electrical power going in). Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a selection of LEDs produced, which meet the color and/or flux requirements for the application.

Consequently, improvements to illumination device that uses light emitting diodes as the light source are desired.

SUMMARY

An illumination device includes Light Emitting Diodes (LEDs). In one embodiment, the illumination device includes a light source sub-assembly having a length dimension extending in a first direction, a width dimension extending in a second direction perpendicular to the first direction, and a plurality of Light Emitting Diodes (LEDs) mounted in a first plane, wherein the width dimension is less than the length dimension. A light conversion sub-assembly is mounted above the first plane and physically separated from the plurality of LEDs and configured to mix and color convert light emitted from the light source sub-assembly. A first portion of a first interior surface of the light conversion sub-assembly is aligned with the first direction and is coated with a first type of wavelength converting material and a first portion of a second interior surface aligned with the second direction reflects incident light without color conversion. A portion of an output window of the light conversion sub-assembly is coated with a second type of wavelength converting material. The first portion of the second interior surface aligned with the second direction and/or a bottom reflector insert may reflect at least 95% of incident light between 380 nanometers and 780 nanometers without color conversion.

In another embodiment, the illumination device includes a mounting board having a length dimension extending in a first direction, a width dimension extending in a second direction perpendicular to the first direction, wherein the length dimension is greater than the width dimension. A plurality of LEDs is mounted to the mounting board. A light mixing cavity is configured to reflect light emitted from the plurality of LEDs until the light exits through an output window that is disposed above the plurality of LEDs and is physically separated from the plurality of LEDs. A first portion of the cavity, which is aligned with the first direction, is coated with a first type of wavelength converting material and a second portion of the cavity, which is aligned with the second direction, reflects incident light without color conversion. A portion of the output window is coated with a second type of wavelength converting material. The second portion of the second interior surface aligned with the second direction and/or a bottom reflector insert may reflect at least 95% of incident light between 380 nanometers and 780 nanometers without color conversion.

In another embodiment, the illumination device includes a plurality of LEDs and a light mixing cavity mounted above and physically separated from the plurality of LEDs and configured to mix and color convert light emitted from the LEDs. A first interior surface of the light mixing cavity includes a replaceable, reflective insert that has a non-metallic, diffuse reflective layer backed by a second reflective layer. The second reflective layer may be specular reflective. The replaceable, reflective insert may be a bottom reflector insert that forms a bottom surface of the light mixing cavity and/or a sidewall insert that forms sidewall surfaces of the light mixing cavity.

In yet another embodiment, the illumination device includes a mounting board having a plurality of raised pads and a plurality of LEDs mounted on the raised pads of the mounting board. A light mixing cavity is configured to reflect light emitted from the plurality of LEDs until the light exits through an output window. The light mixing cavity includes a bottom reflector having a plurality of holes wherein the raised pads elevate the LEDs above a top surface of the bottom reflector through the holes. A first portion of the cavity is coated with a first type of wavelength converting material and a portion of the output window is coated with a second type of wavelength converting material.

Further details and embodiments and techniques are described in the detailed description below. This summary does define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to background examples and some embodiments of the invention, examples of which are illustrated in the accompanying drawings.

Figure 1:
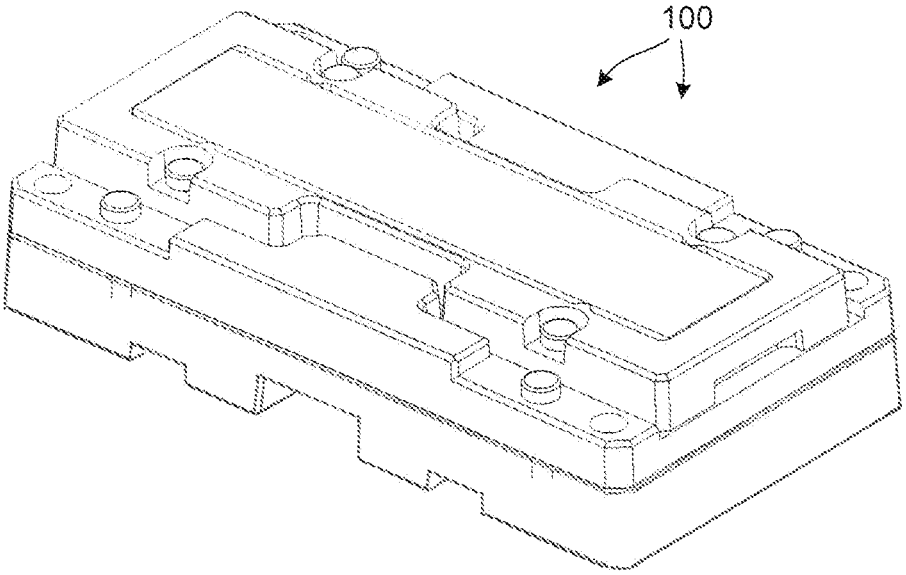
FIG. 1 illustrates a perspective view of an embodiment of a light emitting diode (LED) illumination device.
Figure 2:
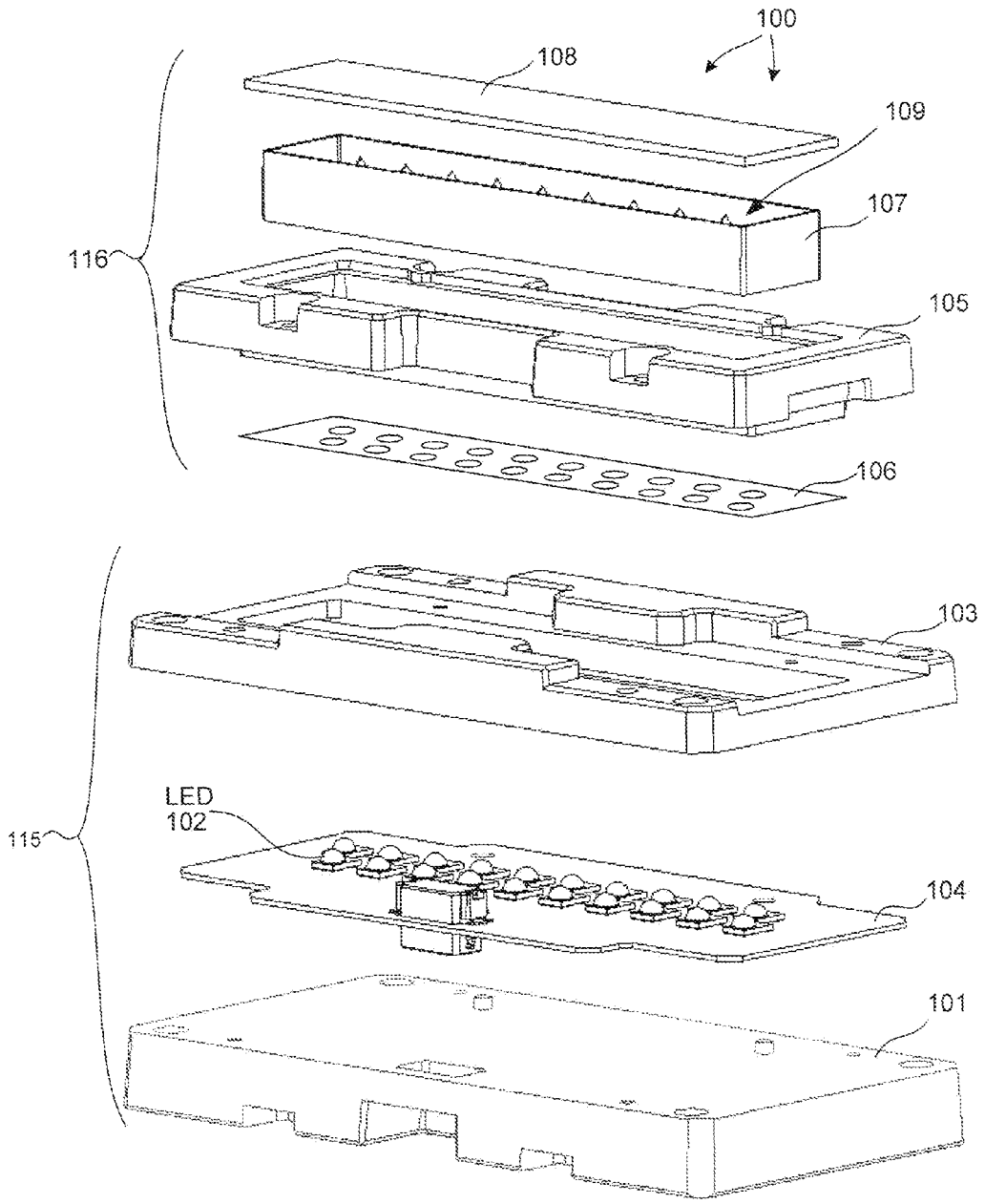
FIG. 2 shows an exploded view illustrating components of the LED illumination device.
Figure 3A:
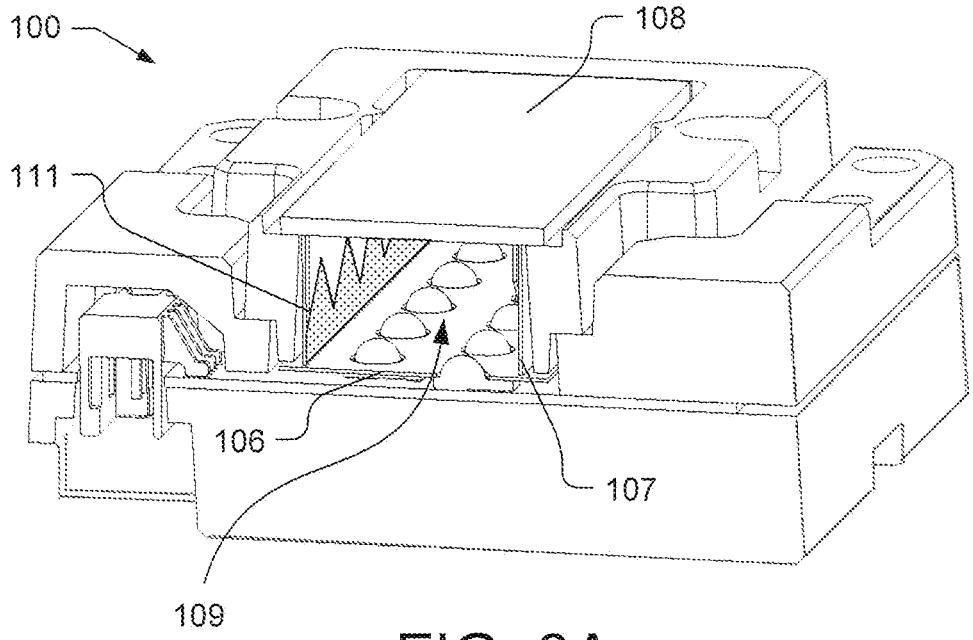
FIGS. 3A and 3B illustrate perspective, cross-sectional views of an embodiment of the LED illumination device.
Figure 3B:
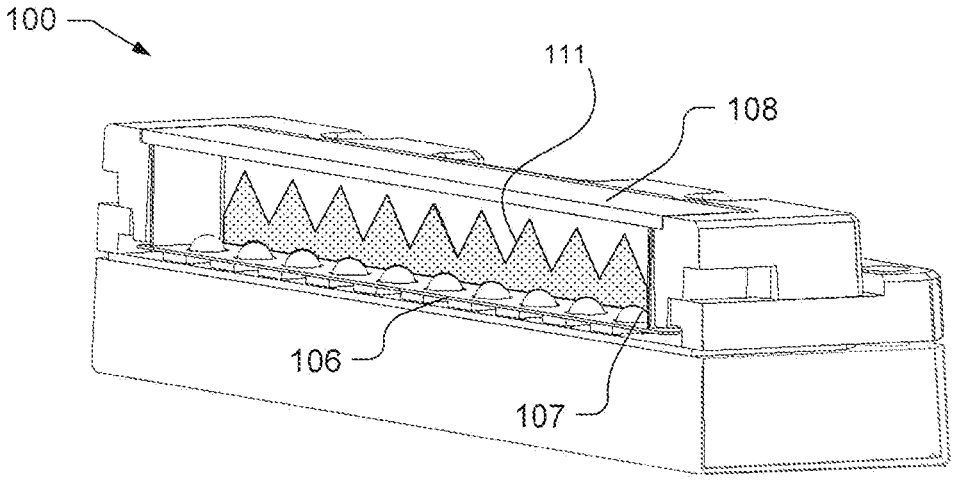

FIG. 1 illustrates a perspective view of an embodiment of a light emitting diode (LED) illumination device 100. FIG. 2 shows an exploded view illustrating components of LED illumination device 100. It should be understood that as defined herein an LED illumination device is not an LED, but is an LED light source or fixture or component part of an LED light source or fixture. LED illumination device 100 includes one or more LED die or packaged LEDs and a mounting board to which LED die or packaged LEDs are attached. FIGS. 3A and 3B illustrate perspective, cross-sectional views of an embodiment of the LED illumination device 100.

Referring to FIG. 2, LED illumination device 100 includes one or more solid state light emitting elements, such as light emitting diodes (LEDs) 102, mounted on mounting board 104. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and output window 108, and optionally includes either or both bottom reflector insert 106 and sidewall insert 107. Output window 108 is fixed to the top of cavity body 105. Cavity body 105 includes interior sidewalls, which may be used to reflect light from the LEDS 102 until the light exits through output window 108 when sub-assembly 116 is mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 reflect the light from the LEDS 102 until the light exits through output window 108 when sub-assembly 116 is mounted over light source sub-assembly 115.

In this embodiment, the sidewall insert 107, output window 108, and bottom reflector insert 106 disposed on mounting board 104 define a light mixing cavity 109 in the LED illumination device 100 in which a portion of light from the LEDs 102 is reflected until it exits through output window 108. Reflecting the light within the cavity 109 prior to exiting the output window 108 has the effect of mixing the light and providing a more uniform distribution of the light that is emitted from the LED illumination device 100.

FIGS. 3A and 3B illustrate cut-away perspective views of light mixing cavity 109. Portions of sidewall insert 107 may including a coating 111 of wavelength converting material, such as phosphor, as illustrated in FIGS. 3A and 3B. Furthermore, portions of output window 108 may be coated with a different wavelength converting material (shown in FIG. 7B). The photo converting properties of these materials in combination with the mixing of light within cavity 109 results in a color converted light output by output window 108. By tuning the chemical properties of the wavelength converting materials and the geometric properties of the coatings on the interior surfaces of cavity 109, specific color properties of light output by output window 108 may be specified, e.g. color point, color temperature, and color rendering index (CRI).

Cavity 109 may be filled with a non-solid material, such as air or an inert gas, so that the LEDs 102 emit light into the non-solid material as opposed to into a solid encapsulant material. By way of example, the cavity may be hermetically sealed and Argon gas used to fill the cavity. Alternatively, Nitrogen may be used.

The LEDs 102 can emit light having different or the same colors, either by direct emission or by phosphor conversion, e.g., where phosphor layers are applied to the LEDs as part of the LED package. Thus, the illumination device 100 may use any combination of colored LEDs 102, such as red, green, blue, amber, or cyan, or the LEDs 102 may all produce the same color light or may all produce white light. For example, the LEDs 102 may all emit either blue or UV light. In addition, the LEDs 102 may emit polarized light or non-polarized light and LED based illumination device 100 may use any combination of polarized or non-polarized LEDs. When used in combination with phosphors (or other wavelength conversion means such as luminescent dyes), which may be, e.g., in or on the output window 108, applied to the sidewalls of cavity body 105, or applied to other components placed inside the cavity (such as sidewall insert 107 and/or bottom reflector insert 106 or other inserted components not shown), the output light of the illumination device 100 has the color as desired. The phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $Lu_3Al_5O_{12}$:Ce, $Ca_8Mg(SiO_4)_4C_{12}$:Eu, $Sr_8Mg(SiO_4)_4Cl_2$:Eu, $La_3Si6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$:Ce, and $Lu_3Ga_5O_{12}$:Ce. The adjustment of color point of the illumination device may be accomplished by replacing sidewall insert 107 and/or the output window 108, which similarly may be coated or impregnated with one or more wavelength converting materials, and are selected based on their performance, such as their color conversion properties.

In one embodiment a red emitting phosphor such as $CaAlSiN_3$:Eu, or (Sr,Ca)$AlSiN_3$:Eu covers a portion of sidewall insert 107 and bottom reflector insert 106 at the bottom of the cavity 109, and a YAG phosphor covers a portion of the output window 108. By choosing the shape and height of the sidewalls that define the cavity, and selecting which of the parts in the cavity will be covered with phosphor or not, and by optimization of the layer thickness of the phosphor layer on the window, the color point of the light emitted from the module can be tuned as desired.

In one example, a single type of wavelength converting material may be patterned on the sidewall, which may be, e.g., the sidewall insert 107 shown in FIG. 3B. By way of example, a red phosphor may be patterned on different areas of the sidewall insert 107 and a yellow phosphor may cover the output window 108, shown in FIG. 7A. The coverage and/or concentrations of the phosphors may be varied to produce different color temperatures. It should be understood that the coverage area of the red and/or the concentrations of the red and yellow phosphors will need to vary to produce the desired color temperatures if the blue light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature. In one example, the thickness of the red phosphor may be, e.g., between 60 μm to 100 μm and more specifically between 80 μm to 90 μm, while the thickness of the yellow phosphor may be, e.g., between 100 μm to 140 μm and more specifically between 110 μm to 120 μm. The red phosphor may be mixed with a binder at a concentration of 1%-3% by volume. The yellow phosphor may be mixed with a binder at a concentration of 12%-17% by volume.

Figure 4:
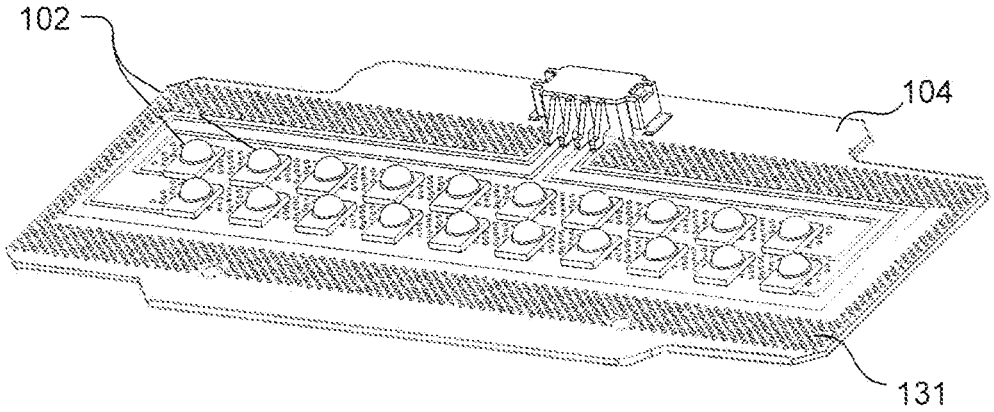
FIG. 4 illustrates a mounting board that provides electrical connections to the attached LEDs and a heat spreading layer for the LED illumination device.

FIG. 4 illustrates mounting board 104 in greater detail. The mounting board 104 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. In addition, different phosphor layers may be applied on different chips on the same submount. The submount may be ceramic or other appropriate material. The submount typically includes electrical contact pads on a bottom surface that are coupled to contacts on the mounting board 104. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas of the LEDs are coupled to heat spreading layers 131 on the mounting board 104. Heat spreading layers 131 may be disposed on any of the top, bottom, or intermediate layers of mounting board 104. Heat spreading layers 131 may be connected by vias that connect any of the top, bottom, and intermediate heat spreading layers.

In some embodiments, the mounting board 104 conducts heat generated by the LEDs 102 to the sides of the board 104 and the bottom of the board 104. In one example, the bottom of mounting board 104 may be thermally coupled to a heat sink 130 (shown in FIG. 9) via mounting base 101. In other examples, mounting board 104 may be directly coupled to a heat sink, or a lighting fixture and/or other mechanisms to dissipate the heat, such as a fan. In some embodiments, the mounting board 104 conducts heat to a heat sink thermally coupled to the top of the board 104. For example, mounting board retaining ring 103 and cavity body 105 may conduct heat away from the top surface of mounting board 104. Mounting board 104 may be an FR4 board, e.g., that is 0.5 mm thick, with relatively thick copper layers, e.g., 30 μm to 100 μm, on the top and bottom surfaces that serve as thermal contact areas. In other examples, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 104 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the board 104 and the electrical connection is made on the opposite side, i.e., the bottom, of the board. Mounting board 104, as illustrated, is rectangular in dimension. LEDs 102 mounted to mounting board 104 may be arranged in different configurations on rectangular mounting board 104. In one example LEDs 102 are aligned in rows extending in the length dimension and in columns extending in the width dimension of mounting board 104. In another example, LEDs 102 have a hexagonal arrangement to produce a closely packed structure. In such an arrangement each LED is equidistant from each of its immediate neighbors. Such an arrangement is desirable to increase the uniformity of light emitted from the light source sub-assembly 115.

Figure 5A:
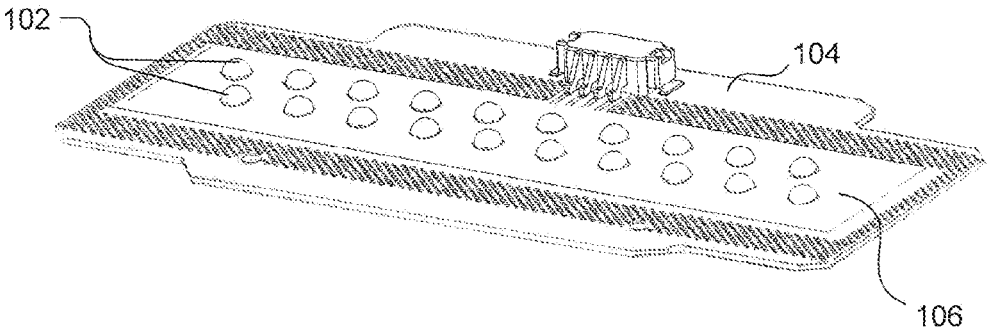
FIG. 5A illustrates a bottom reflector insert attached to the top surface of the mounting board.

FIG. 5A illustrates a bottom reflector insert 106 attached to the top surface of the mounting board 104. The bottom reflector insert 106 may be made from a material with high thermal conductivity and may be placed in thermal contact with the board 104. As illustrated, the bottom reflector insert 106 may be mounted on the top surface of the board 104, around the LEDs 102. The bottom reflector insert 106 may be highly reflective so that light reflecting downward in the cavity 109 is reflected back generally towards the output window 108. The bottom reflector insert, by way of example, may reflect at least 95% of incident light between 380 nanometers and 780 nanometers. Additionally, the bottom reflector insert 106 may have a high thermal conductivity, such that it acts as an additional heat spreader.

Figure 5B:
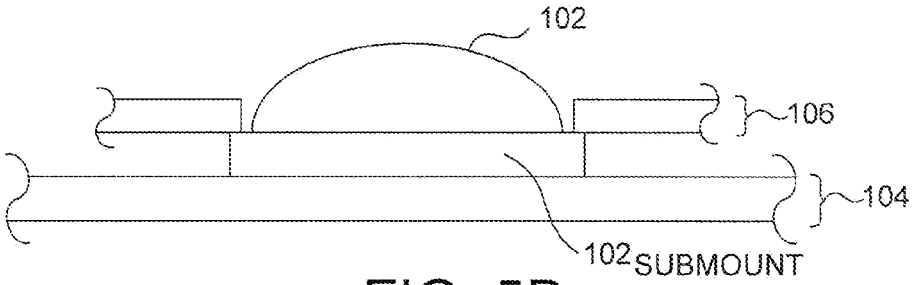
FIG. 5B illustrates a cross-sectional view of a portion of the mounting board, a bottom reflector insert and an LED with a submount, where the thickness of the bottom reflector insert is approximately the same thickness as the submount of the LED.

As illustrated in FIG. 5B, the thickness of the bottom reflector insert 106 may be approximately the same thickness as the submounts $\mathbf{102}_{submount}$ of the LEDs 102 or slightly thicker. Holes are punched in the bottom reflector insert 106 for the LEDs 102 and bottom reflector insert 106 is mounted over the LED package submounts $\mathbf{102}_{submount}$ and the rest of the board 104. In this manner a highly reflective surface covers the bottom of cavity body 105 except in the areas where light is emitted by LEDs 102. By way of example, the bottom reflector insert 106 may be made with a highly thermally conductive material, such as an aluminum based material that is processed to make the material highly reflective and durable. By way of example, a material referred to as Miro®, manufactured by Alanod, a German company, may be used as the bottom reflector insert 106. The high reflectivity of the bottom reflector insert 106 may either be achieved by polishing the aluminum, or by covering the inside surface of the bottom reflector insert 106 with one or more reflective coatings. The bottom reflector insert 106 might alternatively be made from a highly reflective thin material, such as Vikuiti™ ESR, as sold by 3M (USA), which has a thickness of 65 μm.

Figure 5C:
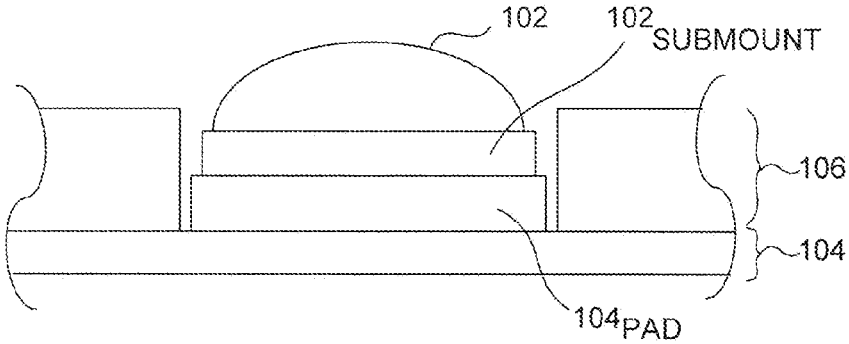
FIG. 5C illustrates another cross-sectional view of a portion of the mounting board, a bottom reflector insert and an LED with a submount, where the thickness of bottom reflector insert is significantly greater than the thickness of the submount of the LED.
Figure 5D:
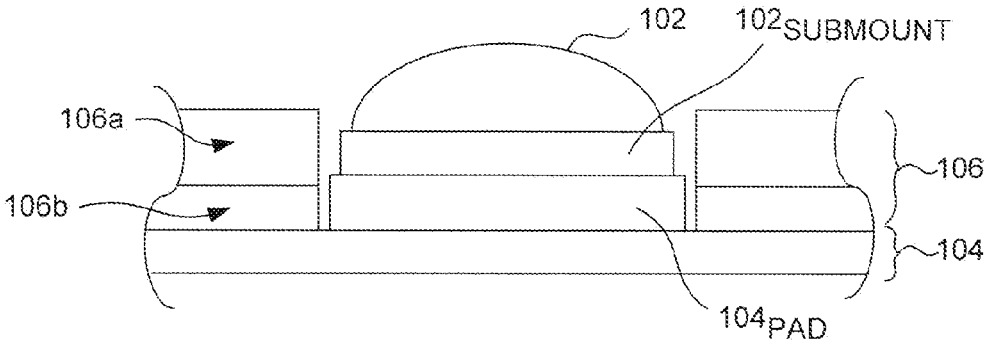
FIG. 5D illustrates another cross-sectional view of a portion of the mounting board, a bottom reflector insert and an LED with a submount, where the bottom reflector insert includes a non-metallic layer and a thin metallic reflective backing layer.

In other examples, bottom reflector insert 106 may be made from a highly reflective non-metallic material such as Lumirror™ E60L manufactured by Toray (Japan) or microcrystalline polyethylene terephthalate (MCPET) such as that manufactured by Furukawa Electric Co. Ltd. (Japan) or a sintered PTFE material such as that manufactured by W.L. Gore (USA). The thickness of bottom reflector insert 106, particularly when constructed from a non-metallic reflective film, may be significantly greater than the thickness of the submounts $\mathbf{102}_{submount}$ of LEDs 102 as illustrated in FIG. 5C. To accommodate for the increased thickness without impinging on light emitted from LEDs 102, holes may be punched in the bottom reflector insert 106 to reveal the submount $\mathbf{102}_{submount}$ of the LED package, and bottom reflector insert 106 is mounted directly on top of mounting board 104. In this manner, the thickness of bottom reflector insert 106 may be greater than the thickness of the submount $\mathbf{102}_{submount}$ without significantly impinging on light emitted by LEDs 102. This solution is particularly attractive when LED packages with submounts that are only slightly larger than the light emitting portion of the LED are employed. In other examples, mounting board 104 may include raised pads $\mathbf{104}_{pad}$ to approximately match the footprint of the LED submount $\mathbf{102}_{submount}$ such that the light emitting portion of LED 102 is raised above bottom reflector insert 106. In some examples, the non-metallic layer 106*a* may be backed by a thin metallic reflective backing layer 106*b* to enhance overall reflectivity as illustrated in FIG. 5D. For example, the non-metallic reflective layer 106*a* may exhibit diffuse reflective properties and the reflective backing layer 106*b* may exhibit specular reflective properties. This approach has been effective in reducing the potential for wave-guiding inside specular reflective layers. It is desirable to minimize wave-guiding within reflective layers because wave-guiding reduces overall cavity efficiency.

The cavity body 105 and the bottom reflector insert 106 may be thermally coupled and may be produced as one piece if desired. The bottom reflector insert 106 may be mounted to the board 104, e.g., using a thermal conductive paste or tape. In another embodiment, the top surface of the mounting board 104 is configured to be highly reflective, so as to obviate the need for the bottom reflector insert 106. Alternatively, a reflective coating might be applied to board 104, the coating composed of white particles e.g. made from TiO2, ZnO, or BaSO4 immersed in a transparent binder such as an epoxy, silicone, acrylic, or N-Methylpyrrolidone (NMP) materials. Alternatively, the coating might be made from a phosphor material such as YAG:Ce. The coating of phosphor material and/or the TiO2, ZnO or GaSO4 material may be applied directly to the board 104 or to, e.g., the bottom reflector insert 106, for example, by screen printing.

Figure 5E:
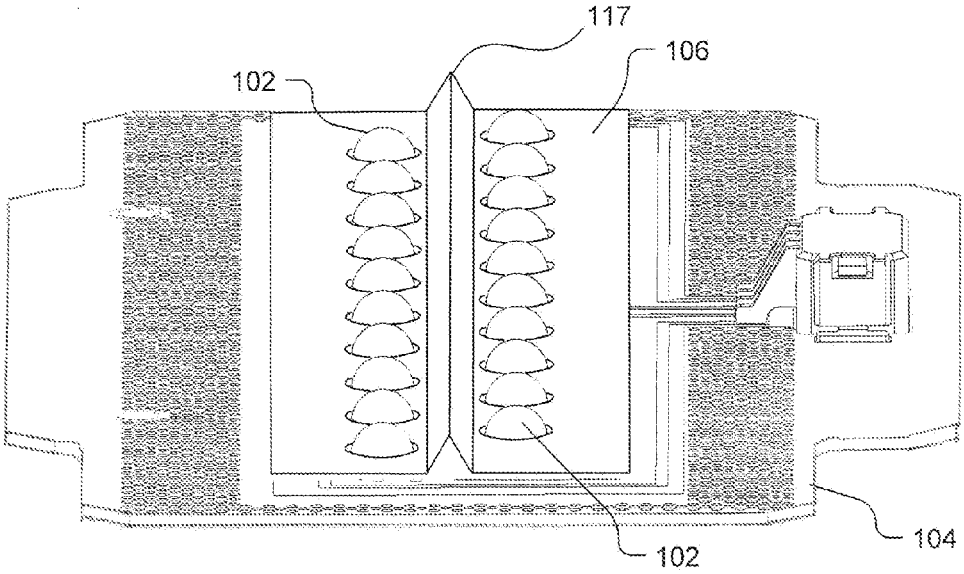
FIG. 5E illustrates a perspective view of another embodiment of the mounting board and bottom reflector insert that includes a raised portion between the LEDs.

FIG. 5E illustrates a perspective view of another embodiment of illumination device 100. If desired, e.g., where a large number of LEDs 102 are used, the bottom reflector insert 106 may include a raised portion between the LEDs 102 such as that illustrated in FIG. 5D. Illumination device 100 is illustrated in FIG. 5D with a diverter 117 between the LEDs configured to redirect light emitted at large angles from the LEDs 102 into narrower angles with respect to a normal to the top surface of mounting board 104. In this manner, light emitted by LEDs 102 that is close to parallel to the top surface of mounting board 104 is redirected upwards toward the output window 108 so that the light emitted by the illumination device has a smaller cone angle compared to the cone angle of the light emitted by the LEDs directly. The use of a bottom reflector insert 106 with a diverter 117 is useful when LEDs 102 are selected that emit light over large output angles, such as LEDs that approximate a Lambertian source. By reflecting the light into narrower angles, the illumination device 100 can be used in applications where light under large angles is to be avoided, for example, due to glare issues (office lighting or general lighting), or due to efficiency reasons where it is desirable to send light only where it is needed and most effective, e.g. task lighting and under cabinet lighting. Moreover, the efficiency of light extraction is improved for the illumination device 100 as light emitted in large angles undergoes fewer reflections in cavity 109 before reaching the output window 108 compared to a device without the bottom reflector insert 106. This is particularly advantageous when used in combination with a light tunnel or integrator, as it is beneficial to limit the flux in large angles due to efficiency losses incurred by repeated reflections in the mixing cavity. The diverter 117 is illustrated as having a tapered shape, but alternative shapes may be used if desired, for example, a half dome shape, or a spherical cap, or aspherical reflector shapes. The diverter 117 can have a specular reflective coating, a diffuse coating, or can be coated with one or more phosphors. The height of the diverter 117 may be smaller than the height of the cavity 109 (e.g., approximately half the height of the cavity 109) so that there is a small space between the top of the diverter 117, and the output window 108. There may be multiple diverters implemented in cavity 109.

Figure 5F:
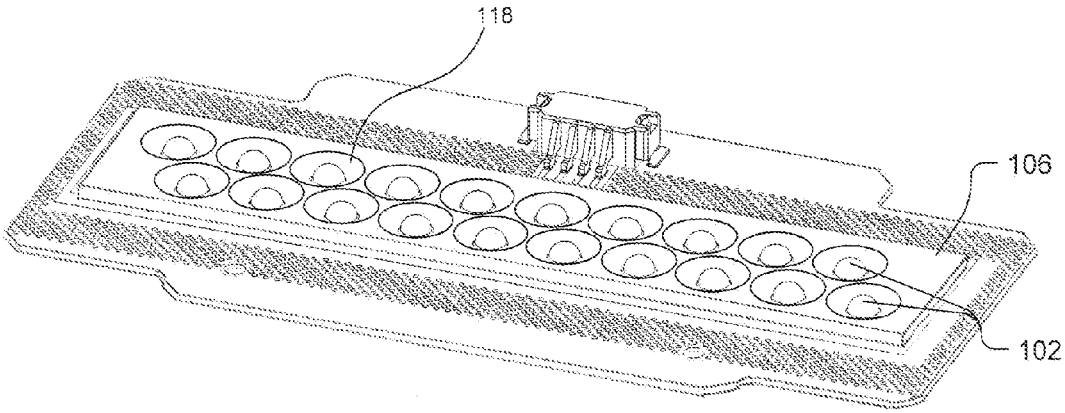
FIG. 5F illustrates another embodiment of a bottom reflector insert where each LED is surrounded by a separate individual optical well.

FIG. 5F illustrates another embodiment of a bottom reflector insert 106 where each LED 102 in illumination device 100 is surrounded by a separate individual optical well 118. Optical well 118 may have a parabolic, compound parabolic, elliptical shape, or other appropriate shape. The light from illumination device 100 is collimated from large angles into smaller angles, e.g., from a 2×90 degree angle to a 2×60 degree angle, or a 2×45 degree beam. The illumination device 100 can be used as a direct light source, for example, as a down light or an under the cabinet light, or it can be used to inject the light into a cavity 109. The optical well 118 can have a specular reflective coating, a diffuse coating, or can be coated with one or more phosphors. Optical well 118 may be constructed as part of bottom reflector insert 106 in one piece of material or may be constructed separately and combined with bottom reflector insert 106 to form a bottom reflector insert 106 with optical well features.

Figure 6A:
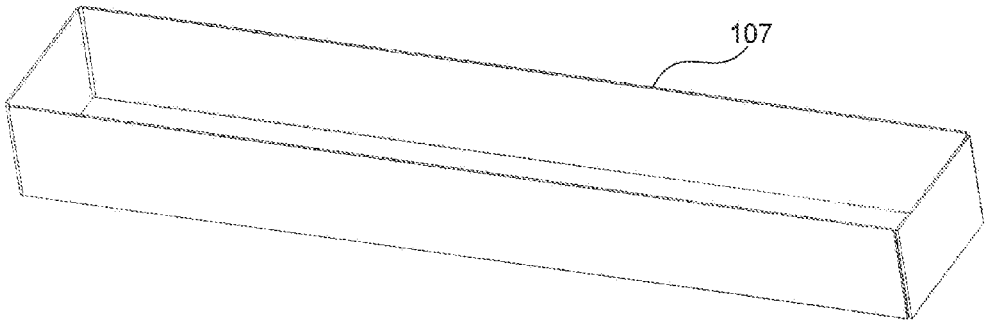
FIG. 6A illustrates an embodiment of sidewall insert used with the illumination device.

FIG. 6A illustrates sidewall insert 107. Sidewall insert 107 may be made with highly thermally conductive material, such as an aluminum based material that is processed to make the material highly reflective and durable. By way of example, a material referred to as Miro®, manufactured by Alanod, a German company, may be used. The high reflectivity of sidewall insert 107 may be achieved by polishing the aluminum, or by covering the inside surface of the sidewall insert 107 with one or more reflective coatings. The bottom reflector insert 106 might alternatively be made from a highly reflective thin material, such as Vikuiti™ ESR, as sold by 3M (USA), which has a thickness of 65 μm. In other examples, bottom reflector insert 106 may be made from a highly reflective non-metallic material such as Lumirror™ E60L manufactured by Toray (Japan) or microcrystalline polyethylene terephthalate (MCPET) such as that manufactured by Furukawa Electric Co. Ltd. (Japan) or a sintered PTFE material such as that manufactured by W.L. Gore (USA). The interior surfaces of sidewall insert 107 can either be specular reflective or diffuse reflective. An example of a highly specular reflective coating is a silver mirror, with a transparent layer protecting the silver layer from oxidation. Examples of highly diffuse reflective materials include MCPET, PTFE, and Toray E60L materials. Also, highly diffuse reflective coatings can be applied. Such coatings may include titanium dioxide (TiO2), zinc oxide (ZnO), and barium sulfate (BaSO4) particles, or a combination of these materials.

In other examples, a non-metallic reflective layer may be backed by a reflective backing layer to enhance overall reflectivity. For example, the non-metallic reflective layer may exhibit diffuse reflective properties and the reflective backing layer may exhibit specular reflective properties. This approach has been effective in reducing the potential for wave-guiding inside specular reflective layers; resulting in increased cavity efficiency.

In one embodiment, sidewall insert 107 may be made of a highly diffuse, reflective MCPET material. A portion of the interior surfaces may be coated with an overcoat layer or impregnated with a wavelength converting material, such as phosphor or luminescent dyes. Such a wavelength converting material will be generally referred to herein as phosphor for the sake of simplicity, although any photoluminescent material, or combination of photoluminescent materials, is considered a wavelength converting material for purposes of this patent document. By way of example, a phosphor that may be used may include $Y_3Al_5O_{12}$:Ce, $(Y,Gd)_3Al_5O_{12}$:Ce, CaS:Eu, SrS:Eu, $SrGa_2S4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $Lu_3Al_5O_{12}$:Ce, $Ca_8Mg(SiO_4)_4C_{12}$:Eu, $Sr_8Mg(SiO_4)_4C_{12}$:Eu, $La_3Si_6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$:Ce, and $Lu_3Ga_5O_{12}$:Ce.

As discussed above, the interior sidewall surfaces of cavity 109 may be realized using a separate sidewall insert 107 that is placed inside cavity body 105, or may be achieved by treatment of the interior surfaces of cavity body 105. Sidewall insert 107 may be positioned within cavity body 105 and used to define the sidewalls of cavity 109. By way of example, sidewall insert 107 can be inserted into cavity body 105 from the top or the bottom depending on which side has a larger opening.

Figure 6B:
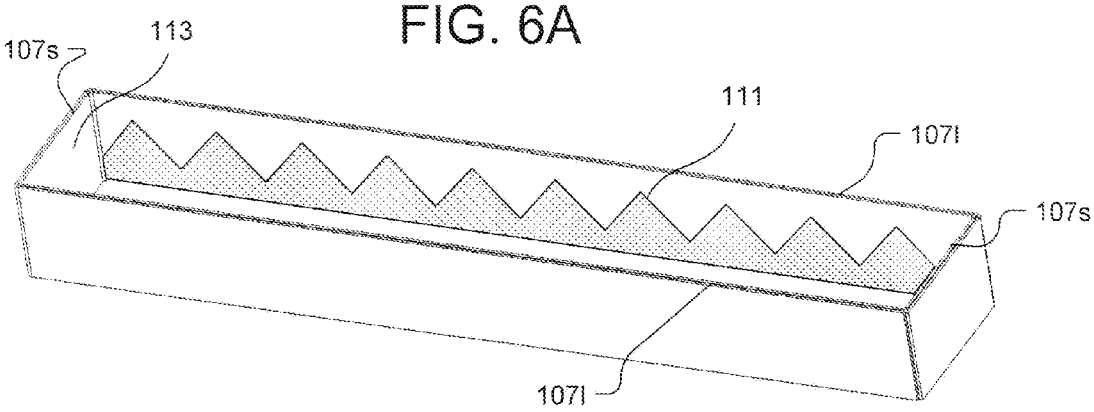
FIGS. 6B and 6C illustrates a perspective view and side view, respectively, of another embodiment of the sidewall insert with a wavelength converting material patterned along the length of the rectangular cavity and no wavelength converting material patterned along the width.
Figure 6C:
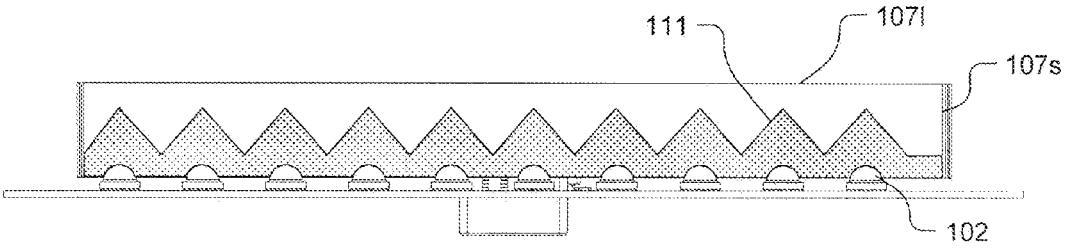

FIGS. 6B-6C illustrate treatment of selected interior sidewall surfaces of cavity 109. As illustrated in FIGS. 6B and 6C, the described treatments are applied to sidewall insert 107, but as discussed above, sidewall insert 107 may not be used and the described treatments may be applied to the interior surfaces of cavity body 105 directly. FIG. 6*b* illustrates a rectangular cavity having a length extending along the longer dimension pictured and a width extending along the shorter dimension pictured. In this example, a reflective coating 113 is applied to the two shorter sidewall surfaces 107*s* and a coating 111 of wavelength converting material is applied along the sidewall surfaces 107*l* corresponding with the length dimension. If desired, the material used to form the sidewall insert 107 itself may be reflective, thereby obviating the need for reflective coating 113. In one embodiment, the shorter sidewall surfaces 107*s* reflect at least 95% of incident light between 380 nanometers and 780 nanometers without color conversion. This combination of treatments to sidewall insert 107, i.e., reflective short sidewall surfaces 107*s* and wavelength converting long sidewalls surfaces 107*l*, has been found to be particularly advantageous. The implementation of a reflective surface on the sidewall surfaces 107*s* corresponding to the width dimension has proven to improve the color uniformity of the output beam emitted from output window 108. FIGS. 6B and 6C illustrate a sawtooth shaped patterned coating 111 where the peak of each sawtooth is aligned with the placement of each LED 102 as illustrated in FIG. 6C. Any portion of the sidewall surfaces 107*l* without coating 111 are reflective and, e.g., may reflect at least 95% of incident light between 380 nanometers and 780 nanometers without color conversion. The implementation of phosphor patterns on the sidewall surfaces 107*l* corresponding to the length dimension where the phosphor pattern is concentrated around the LEDs has also improved color uniformity and enables more efficient use of phosphor materials. Although, a sawtooth pattern is illustrated, other patterns such as semicircular, parabolic, flattened sawtooth patterns, and others may be employed to similar effect. Moreover, if desired, the coating 111 may have no pattern, i.e., the entirety of the sidewall surfaces 107*l* may be coated with phosphor.

Figure 7A:
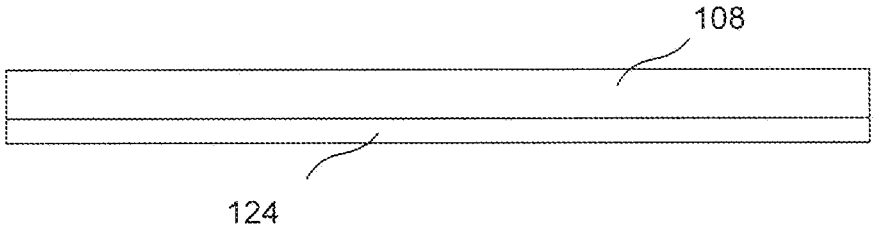
FIG. 7A illustrates a side view of the output window for the illumination device with a layer on the inside surface of the window.
Figure 7B:
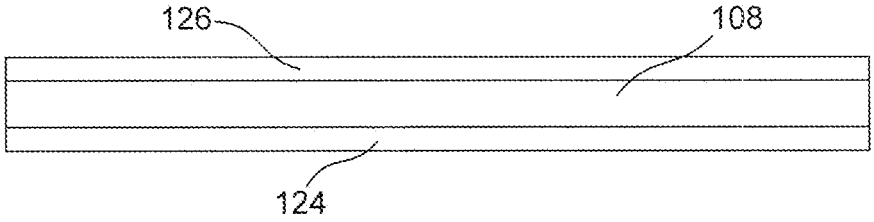
FIG. 7B illustrates a side view of another embodiment of the output window for the illumination device with two additional layers; one on the inside of the window and one on the outside of the window.
Figure 7C:
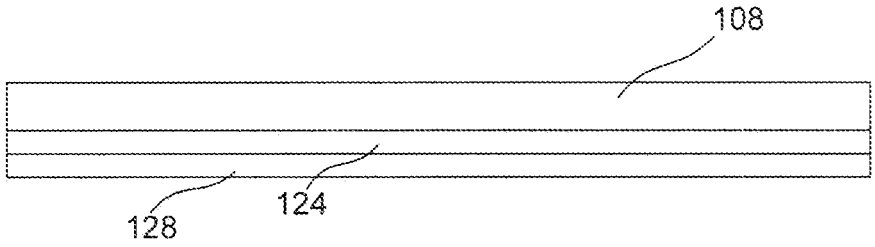
FIG. 7C illustrates a side view of another embodiment of the output window for the illumination device with two additional layers; both on the same inside surface of the window.

FIGS. 7A-7C illustrate various configurations of output window 108 in cross sectional views. In FIGS. 3A and 3B, the window 108 is shown mounted on top of the cavity body 105. It can be beneficial to seal the gap between the window 108 and the cavity body 105 to form a hermetically sealed cavity 109, such that no dust or humidity can enter the cavity 109. A sealing material may be used to fill the gap between the window 108 and the cavity body 105, as for example an epoxy or a silicone material. It may be beneficial to use a material that remains flexible over time due to the differences in thermal expansion coefficients of the materials of the window 108 and cavity body 105. As an alternative, the window 108 might be made of glass or a transparent ceramic material, and soldered onto the cavity body 105. In that case, the window 108 may be plated at the edges with a metallic material, such as aluminum, or silver, or copper, or gold, and solder paste is applied in between the cavity body 105 and window 108. By heating the window 108 and the cavity body 105, the solder will melt and provide a good connection between the cavity body 105 and window 108.

In FIG. 7A, the window 108 has an additional layer 124 on the inside surface of the window, i.e., the surface facing the cavity 109. The additional layer 124 may contain either or both diffusing particles and particles with wavelength converting properties such as phosphors. The layer 124 can be applied to the window 108 by screen printing, spray painting, or powder coating. For screen printing and spray painting, typically the particles are immersed in a binder, which can by a polyurethane based lacquer, or a silicone material. For powder coating a binding material is mixed into the powder mix in the form of small pellets which have a low melting point, and which make a uniform layer when the window 108 is heated, or a base coat is applied to the window 108 to which the particles stick during the coating process. Alternatively, the powder coating may be applied using an electric field, and the window and phosphor particles baked in an oven so that the phosphor permanently adheres to the window. The thickness and optical properties of the layer 124 applied to the window 108 may be monitored during the powder coat process for example by using a laser and a spectrometer, and/or detector, or and/or camera, both in forward scatter and back scattered modes, to obtain the right color and/or optical properties.

In FIG. 7B the window 108 has two additional layers 124 and 126; one on the inside of the window and one on the outside of the window 108, respectively. The outside layer 126 may be light scattering particles, such as TiO2, ZnO, and/or BaSO4 particles. Phosphor particles may be added to the layer 126 to do a final adjustment of the color of the light coming out of the illumination device 100. The inside layer 124 may contain wavelength converting particles, such as a phosphor.

In FIG. 7C the window 108 also has two additional layers 124 and 128, but both are on the same inside surface of the window 108. While two layers are shown, it should be understood that additional layers may be used. In one configuration, layer 124, which is closest to the window 108, includes white scattering particles, such that the window 108 appears white if viewed from the outside, and has a uniform light output over angle, and layer 128 includes a yellow emitting phosphor.

The phosphor conversion process generates heat and thus the window 108 and the phosphor, e.g., in layer 124, on the window 108, should be configured so that they do not get too hot. For this purpose, the window 108 may have a high thermal conductivity, e.g., not less than 1 W/(m K), and the window 108 may be thermally coupled to the cavity body 105, which serves as a heat-sink, using a material with low thermal resistance, such as solder, thermal paste or thermal tape. A good material for the window is aluminum oxide, which can be used in its crystalline form, called Sapphire, as well in its poly-crystalline or ceramic form, called Alumina. Other patterns may be used if desired as for example small dots with varying size, thickness and density.

Figure 8:
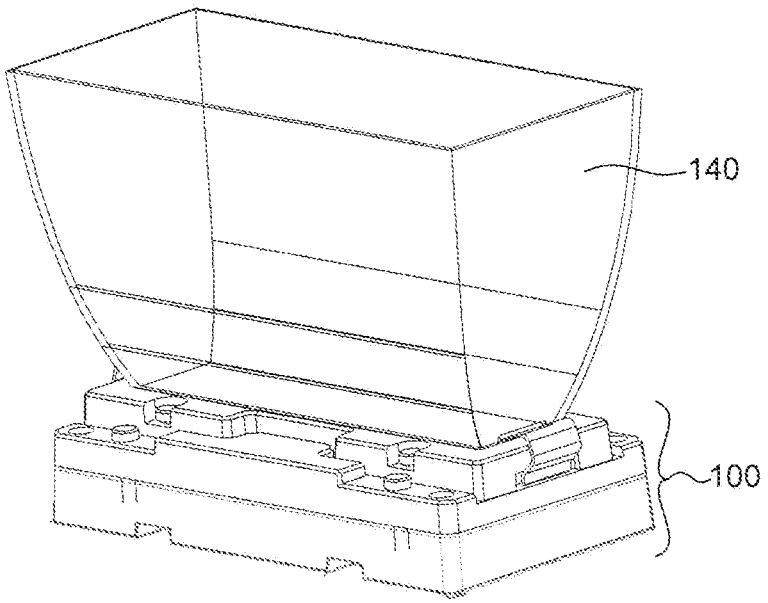
FIG. 8 shows a perspective view of a reflector mounted to illumination device for collimating the light emitted from the illumination device.

FIG. 8 shows a perspective view of a reflector 140 mounted to illumination device 100 for collimating the light emitted from the cavity 109. The reflector 140 may be made out of a thermal conductive material, such as a material that includes aluminum or copper and may be thermally coupled to a heat spreader on the board 104, as discussed in reference to FIG. 4A, along with or through cavity body 105. Heat flows by conduction through heat spreading layers 131 attached to board 104, the thermally conductive cavity body 105, and the thermally conductive reflector 140. Heat also flows via thermal convection over the reflector 140. Reflector 140 may be a compound parabolic concentrator, where the concentrator is made out of a highly reflecting material. Compound parabolic concentrators tend to be tall, but they often are used in a reduced length form, which increases the beam angle. An advantage of this configuration is that no additional diffusers are required to homogenize the light, which increases the throughput efficiency. Optical elements, such as a diffuser or reflector 140 may be removably coupled to the cavity body 105, e.g., by means of threads, a clamp, a twist-lock mechanism, or other appropriate arrangement. In other examples, diffuser or reflector 140 may be coupled to mounting base 101 directly.

Figure 9:
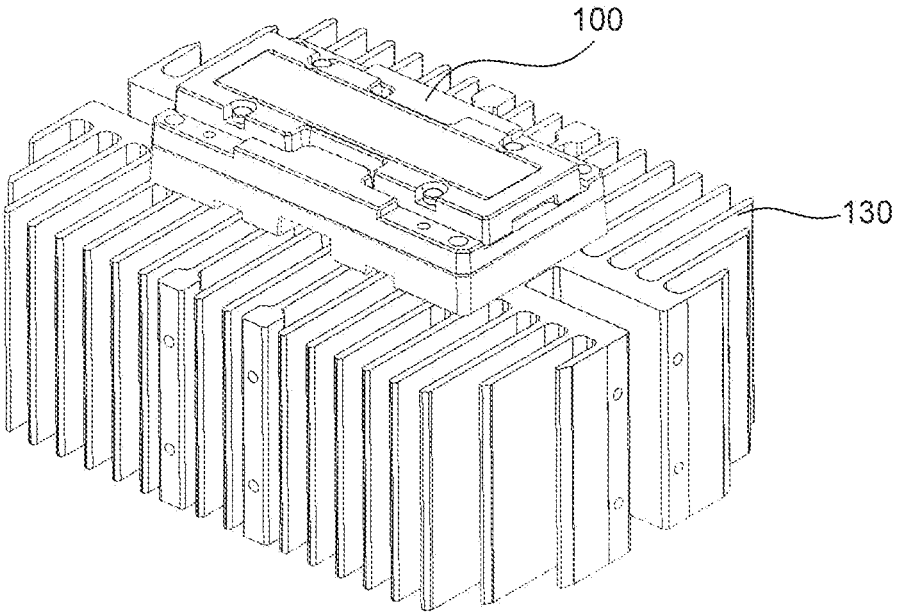
FIG. 9 illustrates illumination device with a bottom heat sink attached.

FIG. 9 illustrates illumination device 100 with a bottom heat sink 130 attached. In one embodiment, the board 104 may be bonded to the heat sink 130 by way of thermal epoxy. Alternatively or additionally, the heat sink 130 may be screwed to the illumination device 100, via screw threads to clamp the illumination device 100 to the heat sink 130, as illustrated in FIG. 9. As can be seen in FIG. 4, the board 104 may include heat spreading layers 131 that act as thermal contact areas that are thermally coupled to heat sink 130, e.g., using thermal grease, thermal tape or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 permits the LEDs 102 to be driven at higher power, and also allows for different heat sink designs, so that the cooling capacity is less dependent on the orientation of the heat sink. In addition, fans or other solutions for forced cooling may be used to remove the heat from the device. The bottom heat sink may include an aperture so that electrical connections can be made to the board 104.

Heat spreading layer 131 on the board 104, shown in e.g., FIG. 4, may be attached to either the reflector, or to a heat sink, such as heat sink 130. In addition, heat spreading layer 131 may be attached directly to an external structure such as a light fixture. In other embodiments, reflector 140 may be made of a metal such as aluminum, copper or alloys thereof, and is thermally coupled to the heat sink 130 to assist in heat dissipation.

As illustrated in FIGS. 1 and 2, multiple LEDs 102 may be used in the illumination device 100. The LEDs 102 are positioned linearly along the length and width dimension shown. The illumination device 100 may have more or fewer LEDs, but twenty LEDs has been found to be a useful quantity of LEDs 102. In one embodiment, twenty LEDs are used. When a large number of LEDs is used, it may be desirable to combine the LEDs into multiple strings, e.g., two strings of ten LEDs, in order to maintain a relatively low forward voltage and current, e.g., no more than 24V and 700 mA. If desired, a larger number of the LEDs may be placed in series, but such a configuration may lead to electrical safety issues.

Any of sidewall insert 107, bottom reflector insert 106, and output window 108 may be patterned with phosphor. Both the pattern itself and the phosphor composition may vary. In one embodiment, the illumination device may include different types of phosphors that are located at different areas of the light mixing cavity 109. For example, a red phosphor may be located on either or both of the sidewall insert 107 and the bottom reflector insert 106 and yellow and green phosphors may be located on the top or bottom surfaces of the window 108 or embedded within the window 108. In one embodiment, a central reflector, e.g., such as diverter 117 shown in FIG. 5E, may have patterns of different types of phosphor, e.g., a red phosphor on a first area and a green phosphor on a separate second area. In another embodiment, different types of phosphors, e.g., red and green, may be located on different areas on the sidewalls of the sidewall insert 107 or the cavity body 105. For example, one type of phosphor may be patterned on the sidewall insert 107 at a first area, e.g., in stripes, spots, or other patterns, while another type of phosphor is located on a different second area of the sidewall insert 107. If desired, additional phosphors may be used and located in different areas in the cavity 109. Additionally, if desired, only a single type of wavelength converting material may be used and patterned in the cavity 109, e.g., on the sidewalls.

Figure 10:
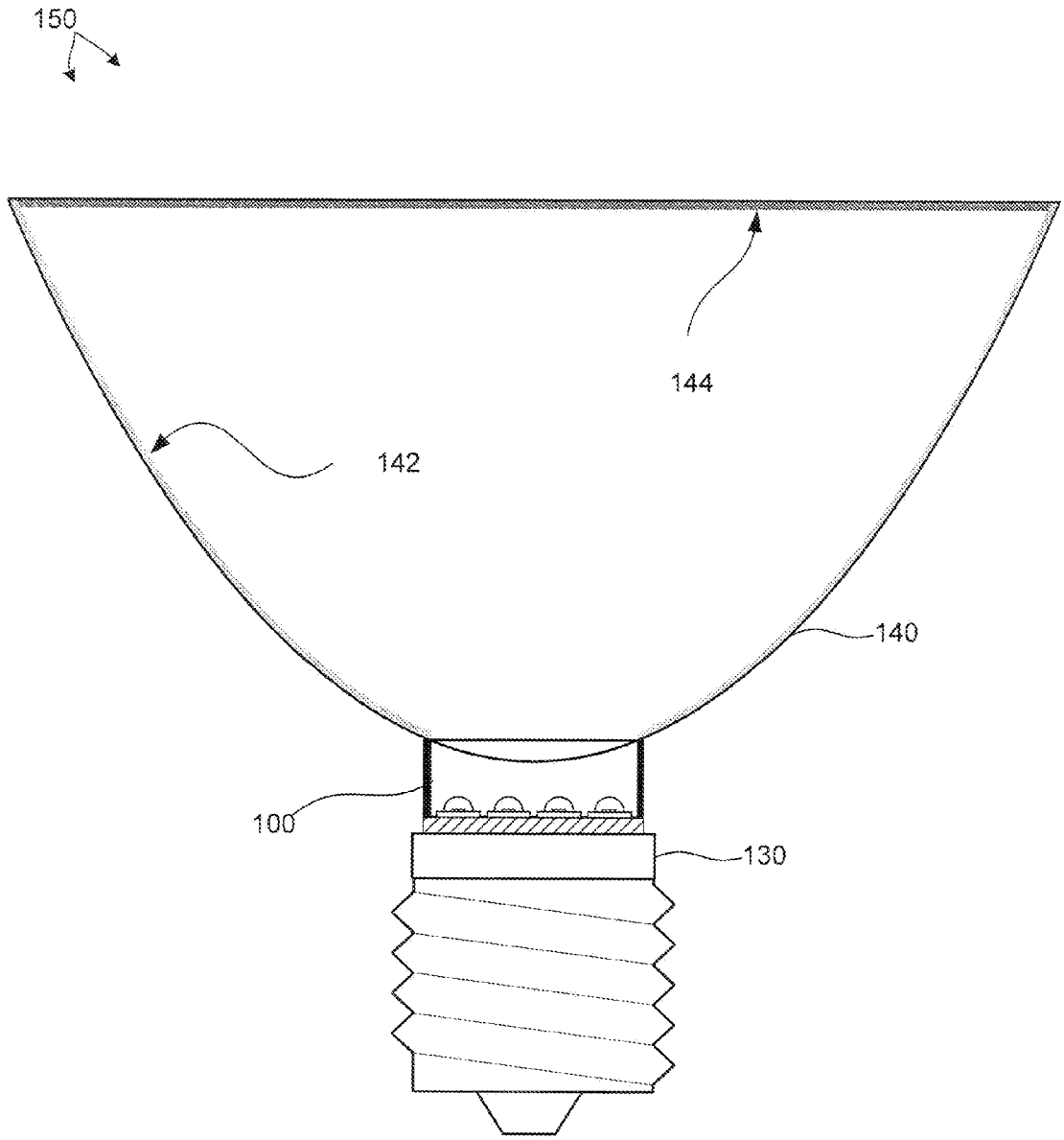
FIG. 10 illustrates a side view of an illumination device integrated into a retrofit lamp device.

The luminaire illustrated in FIG. 10 includes an illumination device 100 integrated into a retrofit lamp device 150. The retrofit lamp device 150 includes a reflector 140 with an internal surface 142 that is polished to be reflective or optionally includes a reflective coating and/or a wavelength converting layer. The reflector 140 may further include a window 144 that may optionally include a coating of a wavelength converting layer or other optical coating such as a dichroic filter. It should be understood that as defined herein an LED based illumination device is not an LED, but is an LED light source or fixture or component part of an LED light source or fixture. In some embodiments, LED based illumination device 100 may be a replacement lamp or retrofit lamp or a part of a replacement lamp or retrofit lamp. As illustrated in FIG. 10, an LED based illumination device 100 may be a part of an LED based retrofit lamp device 150.

Although certain specific embodiments are described above for instructional purposes, the teachings of this patent document have general applicability and are not limited to the specific embodiments described above. For example, FIGS. 3A and 3B illustrate the side walls as having a linear configuration, but it should understood that the sidewalls may have any desired configuration, e.g., curved, non-vertical, beveled etc. For example, a higher transfer efficiency is achieved through the light mixing cavity 109 by pre-collimation of the light using tapered side walls. In another example, cavity body 105 is used to clamp mounting board 104 directly to mounting base 101 without the use of mounting board retaining ring 103. In other examples mounting base 101 and heat sink 130 may be a single component. The examples illustrated in FIGS. 8-10 are for illustrative purposes. Examples of illumination devices of general polygonal and elliptical shapes may also be contemplated. Accordingly, various modifications, adaptations, and combinations of various features of the described embodiments can be practiced without departing from the scope of the invention as set forth in the claims.

What is claimed is:

1. An apparatus comprising:

a light source sub-assembly having a length dimension extending in a first direction, a width dimension extending in a second direction perpendicular to the first direction, and a plurality of Light Emitting Diodes (LEDs) mounted in a first plane, wherein the width dimension is less than the length dimension; and a light conversion sub-assembly mounted above the first plane and physically separated from the plurality of LEDs and configured to mix and color convert light emitted from the light source sub-assembly, the light conversion sub-assembly comprising an output window, wherein a first portion of a first interior sidewall surface of the light conversion sub-assembly is aligned with the first direction and extends generally in a third direction between the first plane and the output window and is coated with a first type of wavelength converting material, wherein an entirety of a second interior sidewall surface aligned with the second direction and extends generally in the third direction between the first plane and the output window reflects incident light without color conversion.

2. The apparatus of claim 1, wherein the entirety of the second interior sidewall surface aligned with the second direction reflects at least 95% of incident light between 380 nanometers and 780 nanometers without color conversion.

3. The apparatus of claim 1, wherein the light conversion sub-assembly includes a bottom reflector insert disposed on top of the first plane, wherein the bottom reflector insert reflects at least 95% of incident light between 380 nanometers and 780 nanometers.

4. The apparatus of claim 3, wherein any of the bottom reflector insert and the entirety of the second interior sidewall surface includes a non-metallic reflective layer disposed above a reflective backing layer.

5. The apparatus of claim 4, wherein the non-metallic reflective layer exhibits diffuse, reflective properties and the reflective backing layer exhibits specular, reflective properties.

6. The apparatus of claim 1, wherein the first interior sidewall surface is a replaceable insert selected for its color conversion properties.

7. The apparatus of claim 1, wherein a second portion of the first interior sidewall surface reflects at least 95% of incident light between 380 nanometers and 780 nanometers without color conversion.

8. The apparatus of claim 1, wherein the output window of the light conversion sub-assembly is coated with a second type of wavelength converting material.

9. The apparatus of claim 1, wherein light scattering particles are mixed with the second type of wavelength converting material.

10. The apparatus of claim 8, wherein the output window includes a third type of wavelength converting material.

11. An apparatus comprising:

a mounting board having a plurality of raised pads;

a plurality of Light Emitting Diodes (LEDs) mounted on submounts having a first thickness, the plurality of LEDS mounted on submounts being mounted on the plurality of raised pads of the mounting board;

a light mixing cavity configured to reflect light emitted from the plurality of LEDs until the light exits through an output window, the light mixing cavity comprising a bottom reflector having a second thickness that is greater than the first thickness of the submounts and having a plurality of holes, the plurality of LEDs are elevated by the plurality of raised pads above a top surface of the bottom reflector through the plurality of holes, wherein a first portion of the light mixing cavity is coated with a first type of wavelength converting material, and wherein a portion of the output window is coated with a second type of wavelength converting material.

12. The apparatus of claim 11, wherein a second portion of the light mixing cavity reflects the light emitted from the plurality of LEDs without color conversion.

13. The apparatus of claim 11, wherein the bottom reflector includes a non-metallic reflective layer disposed above a reflective backing layer.

14. The apparatus of claim 13, wherein the non-metallic reflective layer exhibits diffuse, reflective properties and the reflective backing layer exhibits specular, reflective properties.

* * * * *